US005183701A

United States Patent [19]

Jacobs et al.

[11] Patent Number: 5,183,701

[45] Date of Patent: Feb. 2, 1993

[54] ARTICLES OF HIGHLY ORIENTED POLYOLEFINS OF ULTRAHIGH MOLECULAR WEIGHT, PROCESS FOR THEIR MANUFACTURE, AND THEIR USE

[75] Inventors: Martinus J. N. Jacobs, Galeen; Hendrikus J. J. Rutten, Maastricht, both of Netherlands

[73] Assignee: Dyneema V.O.F., Sittard, Netherlands

[21] Appl. No.: 747,490

[22] Filed: Aug. 19, 1991

Related U.S. Application Data

[63] Continuation of Ser. No. 251,453, Sep. 30, 1988, abandoned.

[30] Foreign Application Priority Data

Oct. 2, 1987 [DE] Fed. Rep. of Germany ..... 3733426

[51] Int. Cl.[5] ..... B32B 33/00; C08J 5/06; D06M 10/04; D06M 10/06

[52] U.S. Cl. ..... 428/229; 204/165; 204/168; 427/322; 427/412; 427/412.3; 427/491; 427/536; 427/538; 428/265; 428/361; 428/378; 428/380; 428/394; 428/409; 428/902

[58] Field of Search ..... 204/165, 168; 427/37, 427/38, 322, 412, 412.3; 428/229, 265, 361, 378, 380, 394, 409, 902

[56] References Cited

U.S. PATENT DOCUMENTS 4,445,991 5/1984 Arbit .
4,536,271 8/1985 Collins .

FOREIGN PATENT DOCUMENTS 0062491 10/1982 European Pat. Off. .

OTHER PUBLICATIONS

Hans Gropper et al., Polyolefine, p. 175, Ullman's Eycyclopadie der techischen Chemie.

*Primary Examiner*—James C. Cannon
*Attorney, Agent, or Firm*—Cushman, Darby & Cushman

[57] ABSTRACT

The invention relates to articles consisting of highly oriented polyolefins having an ultrahigh molecular weight of more than 600,000 g/mol (weight-average molecular weight), especially filaments, fibers, yarns, fabrics and films, having good wetting and adhesive properties, especially on conventional matrix materials, which have been subjected to a plasma treatment of their surface, and also to a process for producing these articles and to their use for the manufacture of composites with the use of conventional matrix materials. In these composites, yarns according to the invention, for example, show a substantially higher adhesive strength than corresponding yarns which have not been plasma-treated, their tensile strength not being impaired by the plasma treatment.

12 Claims, No Drawings

ARTICLES OF HIGHLY ORIENTED POLYOLEFINS OF ULTRAHIGH MOLECULAR WEIGHT, PROCESS FOR THEIR MANUFACTURE, AND THEIR USE

This is a continuation of application Ser. No. 07/251,453, filed on Sep. 30, 1988 is now abandoned.

The invention relates to articles consisting of highly oriented polyolefins having an ultrahigh molecular weight of more than 600,000 g/mol (weight-average molecular weight), especially filaments, fibers, yarns, fabrics and films, having good wetting and adhesive properties, especially on conventional matrix materials, to a process for the manufacture of these articles and to their use for the manufacture of composites.

EP-A 0,006,275 has disclosed a process for improving the adhesive properties of aromatic polyamide fibers, which process comprises subjecting the fibers to a plasma treatment. The disadvantage of this process is that the tensile strength of the fibers is reduced by the plasma treatment.

EP-A 0,062,491 describes a process for the manufacture of composite materials, wherein a reinforcing material is embedded in a conventional polymer matrix, which reinforcing material can consist of filaments and fibers of polyolefins having a molecular weight of less than 300,000 and which is subjected to a plasma treatment in order to improve its adhesive properties on the matrix material. In this case again, a reduction in the tensile strength of the plasma-treated reinforcing materials must be accepted.

It was the object of the invention to improve the wetting and adhesive properties, especially on conventional matrix materials, of polyolefin articles such as, in particular, filaments, fibers, yarns, fabrics and films, without at the same time reducing their tensile strengths.

The invention achieves this object by subjecting articles consisting of highly oriented polyolefins having an ultrahigh molecular weight of more than 600,000 g/mol (weight-average molecular weight), especially filaments, fibers, yarns, fabrics and films, to a plasma treatment of their surface.

Surprisingly, the tensile strength of the plasma-treated articles, which is very high due to the high degree of orientation and the ultrahigh molecular weight, is not reduced as a result, so that the articles according to the invention are outstandingly suitable as reinforcing materials for the manufacture of composites with the use of conventional matrix materials.

Preferably, the articles according to the invention consist of polyethylenes, especially linear polyethylenes, having an ultrahigh molecular weight of 600,000 to 6,000,000 g/mol and higher.

The articles according to the invention are especially filaments, fibers, yarns, fabrics and films, which are used above all for the manufacture of composite materials in such a way that they are embedded as reinforcing materials, if appropriate together with other conventional reinforcing materials such as glass fibers, graphite fibers and the like, in polymeric matrix materials, for example thermosetting resins such as phenolic resins, epoxy resins, vinyl ester resins, polyester resins, acrylate resins and the like, or polar thermoplastic matrix materials such as polymethyl (meth)acrylate. As a result of the plasma treatment according to the invention, which does not cause any reduction in tensile strength, the filaments, fibers etc. according to the invention show good adhesion to the matrix materials, so that their high tensile strength is fully exploited.

The high degree of orientation of the articles according to the invention is, in the case of filaments, or fibers, yarns and fabrics manufactured from them, produced in such a way that the filaments are subjected to extensive stretching, especially at a stretching ratio of more than 20 and in particular more than 30, whereas the films can have been uniaxially or biaxially stretched at similar stretching ratios.

The articles which consist of highly oriented polyolefins and are subjected according to the invention to a plasma treatment, are preferably produced by the so-called gel process which comprises dissolving the particular polyolefin, especially polyethylene, of ultrahigh molecular weight in a solvent, forming the solution at a temperature above the dissolution temperature of the polyolefin to give a filament or tape, cooling the filament or tape to a temperature below the dissolution temperature for gelling or solvent removal and then stretching. Such a process for the production of filaments is described, for example, in GB-A 2,042,414 and 2,051,667, whereas the production of a highly oriented, biaxially stretched film from polyolefins of ultrahigh molecular weight is the subject of, for example, German Offenlegungsschrift 3,724,434.

Preferably, the articles according to the invention consist of polyethylenes, especially linear polyethylenes, which can contain minor quantities, preferably at most 5 mol-%, of one or more alkenes which are copolymerizable therewith, such as propylene, butylene, pentene, hexene, 4-methylpentene, octene and the like. Preferably, the polyethylenes can contain 1 to 10 and especially 2 to 6 methyl or ethyl groups per 1,000 carbon atoms. As mentioned, however, other polyolefins can also be used, for example polypropylene homopolymers and copolymers, and the polyolefins can also contain minor quantities of one or more other polymers, especially 1-alkene polymers.

According to the invention, the filaments or the products manufactured from them and the films can also be porous and, in this case, they preferably have a density between 0.1 and 0.9 g/cm$^3$. They can be produced by controlling the evaporation of the solvent from the gel filaments or tapes in such a way that pores remain.

The process according to the invention for producing the plasma-treated articles consisting of highly oriented polyolefins of ultrahigh molecular weight comprises subjecting these articles to a plasma treatment of their surface, if necessary after pre-cleaning. The pre-cleaning can comprise, for example, a solvent treatment for removing sizes adhering to the surface and serves for making available a clean surface of the articles to be treated for the plasma treatment.

The plasma treatment is carried out with inert and/or reactive gases or gas mixtures, the use of reactive gases being preferred. Nitrogen and helium may be mentioned as inert gases, and air, oxygen, carbon dioxide and ammonia may be mentioned as reactive gases.

Preferably, the plasma treatment is carried out under a pressure from 0.2 to 5 mmHg, especially 1 mmHg, and at an energy density from 5 to 100 kW/m$^3$, especially between 15 and 50 kW/m$^3$, and in particular at room temperature and with a residence time of 5 seconds to 200 seconds.

It is also advantageous, immediately after the plasma treatment, to carry out a chemical treatment in order to improve the wetting and adhesive properties of the plasma-treated articles, which chemical treatment provides additional active groups on the surface of the articles, for example carboxyl groups, hydroxyl groups or carbonyl groups. Such a treatment can be carried out, for example, with unsaturated compounds such as acrylic acid, acrylamides, maleic acid, glycidyl methacrylate, hydroxyethyl methacrylate, itaconic acid, vinyl acetate and the like. Preferably, a polymerization inhibitor is used in this case, such as an iron (III) compound, in order to avoid polymerization of the unsaturated compounds. For example, such a chemical treatment can be effected by introducing the plasma-treated articles into a solution of one of the unsaturated compounds mentioned, such as, for example, into an acrylic acid solution, but a chemical aftertreatment can also be effected in the gas phase. Chemical processes of this type for improving the adhesive properties of polyolefin are known.

In an advantageous manner, polyolefin filaments, from which fibers, yarns and fabrics can then be manufactured, are employed for carrying out the process according to the invention. Equipment for the plasma treatment of filaments is described in EP-A 0,006,275. This equipment comprises a capillary inlet and outlet or several such inlets and outlets, through which the filaments are drawn continuously through the equipment, in which they undergo a plasma treatment. However, equipment can also be used, in which the filaments circulate in the interior of the plasma chamber, in which case they can be taken around deflection rollers in any desired number of loops, depending on the desired residence time.

It is also possible, however, to treat large-area fabrics or films in correspondingly sized plasma treatment equipment.

From composites which are produced especially with the use of filaments, fibers, yarns and fabrics according to the invention as the reinforcing materials, especially sports articles are manufactured, such as tennis raquets, golf clubs and the like, and helmets, boats, antiballistic articles, high-pressure hoses or the like can also be manufactured with the use of these composite materials.

EXAMPLE

An 800 dtex yarn consisting of about 400 monofilaments of a polyethylene of a molecular weight of approximately $1.9\times10^6$ and having a strength of 2.4 GPa and a modulus of elasticity of 90 GPa is washed in carbon tetrachloride for size removal.

This yarn is then subjected to a plasma treatment under a pressure of 1 mmHg at 25° C. and at an energy density of 30 kW/m$^3$ for a period of 50 seconds by the action of an air plasma.

Using this yarn, a composite specimen of 50% by volume of yarn and 50% by volume of a resin (100 parts of Eurepox 730®, manufactured by Schering, and 20 parts of a curing agent (XE 278)) is produced in a width of 3 mm, a height of 4 mm and a length of 150 mm. This specimen is fully cured for 1½ hours at 23° C. and 1 hour at 80° C., whereupon specimens of 18 mm length are cut off, and the interlaminar shear strength is determined by ASTM Method D2344 (accelerated bending test) at a bending speed of 2 mm/min.

For comparison purposes, an identical composite specimen is prepared using a yarn which has not been subjected to a plasma treatment.

The interlaminar shear strength is 30.6±0.7 MPa in the case of the plasma-treated yarn and 12.9±0.8 MPa in the case of the untreated yarn.

The corresponding tensile strength values are 2.5±0.15 GPa and 2.4±0.05 GPa respectively.

These values show that the yarns according to the invention have twice the adhesive strength of an untreated yarn, at the same tensile strength.

We claim:

1. A polyolefin article having good wetting and adhesive properties for use in combination with matrix materials in the manufacture of composite materials, comprising highly oriented polyolefins having molecular weights greater than 600,000 g/mol, a surface of said article being subjected to a plasma treatment in the presence of reactive gases, wherein the plasma treatment is carried out under a pressure from 0.2 to 5 mmHg, and at an energy density from 5 to 100 kW/m$^3$, with a residence time from 5 seconds to 200 seconds and wherein tensile strength of the plasma treated article is not essentially modified.

2. Articles as claimed in claim 1, which consist of polyethylenes.

3. The article as claimed in claim 1, wherein the articles are filaments, fibers, yarns, fabrics or films.

4. A composite comprising an article according to claim 1.

5. A process for the manufacture of articles having good wetting and adhesive qualities for use in combination with matrix materials in the manufacture of composite materials, which comprises subjecting the surface of articles comprising highly oriented filaments, fibers, yarns, fabrics and films consisting of polyolefins of ultrahigh molecular weight to a plasma treatment, wherein the plasma treatment is carried out at an energy density of 5 to 30 kW/m$^3$, with a residence time of 5 seconds to 50 seconds in the presence of reactive gases.

6. A polyolefin article having good wetting and adhesive properties for use in combination with matrix materials in the manufacture of composite materials, comprising highly oriented polyolefins having molecular weights greater than 600,000 g/mol, a surface of said article being subjected to a plasma treatment in the presence of reactive gases, wherein the plasma treatment is carried out at an energy density of at most 30 kW/m$^3$, with a residence time of 5 seconds to 50 seconds.

7. A process for the manufacture of articles having good wetting and adhesive qualities for use in combination with matrix materials in the manufacture of composite materials, which comprises subjecting the surface of articles comprising highly oriented filaments, fibers, yarns, fabrics and films consisting of polyolefins of ultrahigh molecular weight to a plasma treatment, wherein the plasma treatment is carried out under a pressure from 0.2 to 5 mmHg, and at an energy density from 5 to 100 kW/m$^3$, with a residence time from 5 seconds to 200 seconds in the presence of reactive gases and wherein tensile strength of the plasma treated articles is not essentially modified.

8. A process as claimed in claim 7, wherein a chemical treatment is carried out on the article in order to improve the wetting and adhesive properties and wherein said chemical treatment provides additional active groups on the surface of the article.

9. The process of claim 7, wherein the polyolefins are linear polyethylenes.

10. The process of claim 3, wherein the plasma treatment is carried out at a pressure of approximately 1 mmHg.

11. The process of claim 7, wherein the articles are subjected to pre-cleaning prior to said plasma treatment.

12. The process of claim 3, wherein the plasma treatment is carried out at approximately room temperature.

* * * * *